US007574297B2

(12) United States Patent
Pauer

(10) Patent No.: US 7,574,297 B2
(45) Date of Patent: Aug. 11, 2009

(54) FUEL INJECTION DEVICE FOR AN INTERNAL COMBUSTION ENGINE

(75) Inventor: Thomas Pauer, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 59 days.

(21) Appl. No.: 11/813,527

(22) PCT Filed: Jan. 25, 2006

(86) PCT No.: PCT/EP2006/050445

§ 371 (c)(1),
(2), (4) Date: Jul. 9, 2007

(87) PCT Pub. No.: WO2006/100141

PCT Pub. Date: Sep. 28, 2006

(65) Prior Publication Data

US 2008/0189025 A1 Aug. 7, 2008

(30) Foreign Application Priority Data

Mar. 21, 2005 (DE) ..... 10 2005 012 940

(51) Int. Cl.
*F02D 41/30* (2006.01)

(52) U.S. Cl. ..... 701/103; 123/457

(58) Field of Classification Search ..... 123/456, 123/457, 458, 506, 507, 508, 447, 490, 510; 701/103, 104

See application file for complete search history.

(56) References Cited

U.S. PATENT DOCUMENTS 6,889,657 B2 * 5/2005 Ruesseler et al. ..... 123/446
7,017,553 B2 * 3/2006 Boehland ..... 123/446
7,063,073 B2 * 6/2006 Ausiello et al. ..... 123/446
2002/0134355 A1 9/2002 Boehm et al.
2003/0098016 A1 5/2003 Rembold et al.
2004/0187848 A1 9/2004 Hlousek

FOREIGN PATENT DOCUMENTS

| | | | |
|---|---|---|---|
| DE | 100 04 617 | A1 | 8/2001 |
| DE | 102 36 314 | A1 | 4/2003 |
| EP | 1 262 659 | A2 | 12/2002 |
| EP | 1 557 597 | A1 | 7/2005 |
| WO | WO 02/25099 | A1 | 3/2002 |

* cited by examiner

*Primary Examiner*—Stephen K. Cronin
*Assistant Examiner*—Johnny H. Hoang
(74) *Attorney, Agent, or Firm*—Ronald E. Greigg

(57) ABSTRACT

A fuel injection device comprising a high-pressure pump supplying a fuel to a high-pressure area in which an injector for injecting fuel into an internal combustion engine cylinder is arranged. An electric control unit for controlling fuel injection by at least one injector is provided. A pressure adjusting valve which adjusts a pressure in the high-pressure area and controls a connection between said high pressure area and a low-pressure fuel-filled area is controlled by the control unit. When the pressure adjusting valve is not controlled by the control unit it is placed in an open switching position in such a way that the connection between the high- low-pressure areas is opened, thereby preventing a gas formation in the high pressure area when the internal combustion engine is switched off and the fuel is cooled.

20 Claims, 3 Drawing Sheets

FUEL INJECTION DEVICE FOR AN INTERNAL COMBUSTION ENGINE

CROSS-REFERENCE TO RELATED APPLICATION

This application is a 35 USC 371 application of PCT/EP 2006/050445 filed on Jan. 25, 2006.

BACKGROUND OF THE INVENTION

1. Field of the Invention

The invention is directed to an improved fuel injection device for an internal combustion engine.

2. Description of the Prior Art

A fuel injection device, known from DE 100 04 617 A, has a high pressure pump that delivers fuel into a high-pressure region in which for example one high-pressure accumulator, a so-called rail, is provided. An injector for fuel injection is provided for each cylinder of the engine; each injector is connected to the high-pressure accumulator via a hydraulic line. An electric control unit is provided for controlling the fuel injection by means of the injectors. Both the lines to the injectors and the injectors themselves are components of the high-pressure region. A pressure control valve that is triggered by the control unit is provided for setting a certain pressure in the high-pressure region. The pressure control valve controls a connection between the high-pressure region and a low-pressure region. When the pressure control valve is triggered by the control unit, it opens the connection between the high-pressure region and the low-pressure region so that fuel can flow out of the high-pressure region into the low-pressure region. In new fuel injection devices, the high-pressure region is completely leak-tight. When the internal combustion engine is switched off after long operation, the fuel contained in the high-pressure region is heated. Upon subsequent cooling, the complete leak-tightness of the high-pressure region can cause a degassing of the fuel to occur. This impedes the restarting of the internal combustion engine since it is first necessary to displace the gas in the high-pressure region.

SUMMARY AND ADVANTAGES OF THE INVENTION

The fuel injection device according to the invention has the advantage over the prior art that when the internal combustion engine is switched off and the control unit is not triggering the pressure control valve, the high-pressure region is connected to the low-pressure region, thus preventing a degassing of the fuel in the high-pressure region. No additional structural complexity is required in comparison to the known fuel injection device.

Advantageous embodiments and modifications of the fuel injection device according to the invention are disclosed.

BRIEF DESCRIPTION OF THE DRAWINGS

Several exemplary embodiments of the invention are described herein below, with reference to the drawings, in which.

DESCRIPTION OF THE PREFERRED EMBODIMENTS

Figure 1:
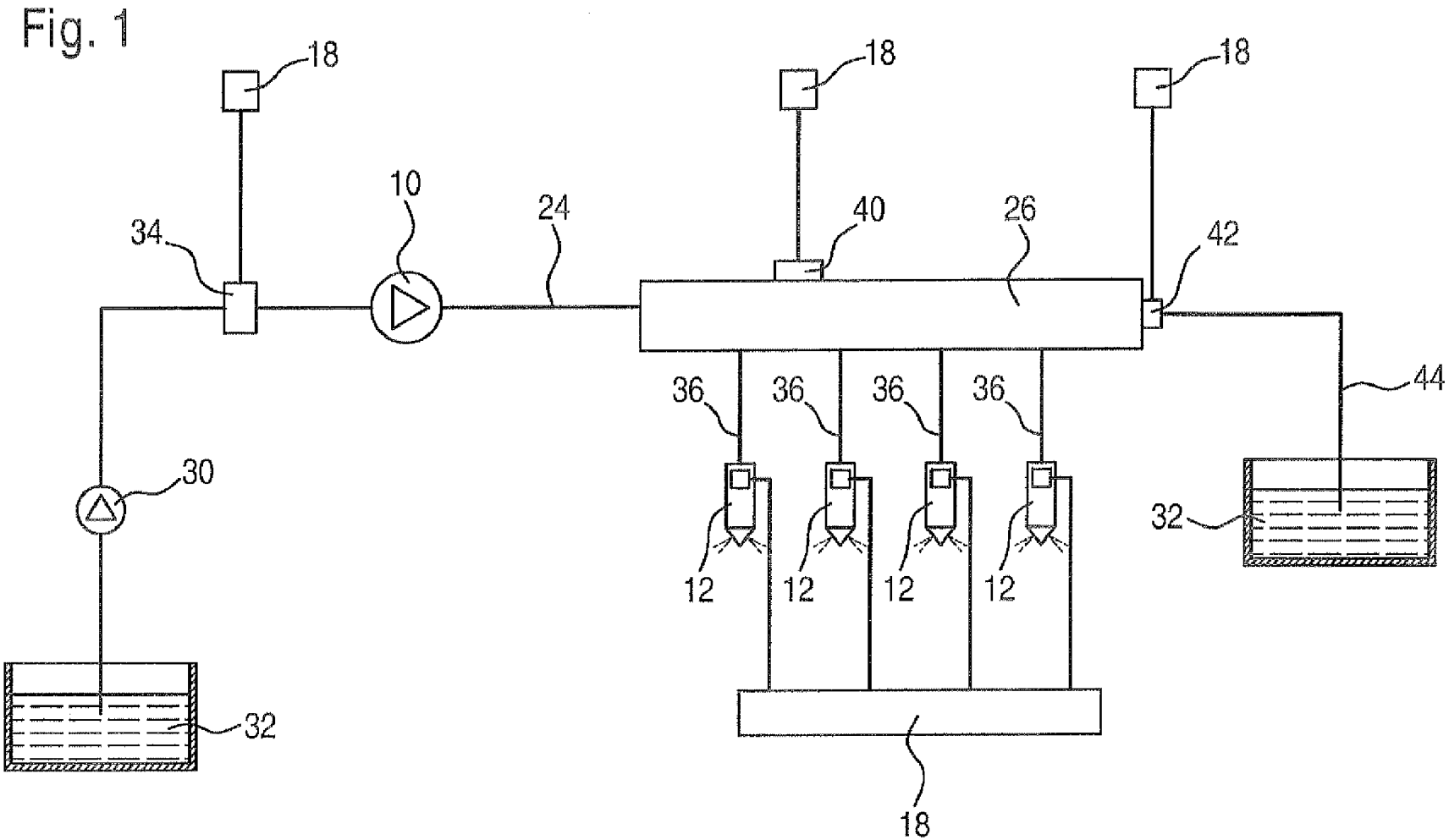
FIG. 1 is a simplified depiction of a fuel injection device for an internal combustion engine according to a first exemplary embodiments.
Figure 2:
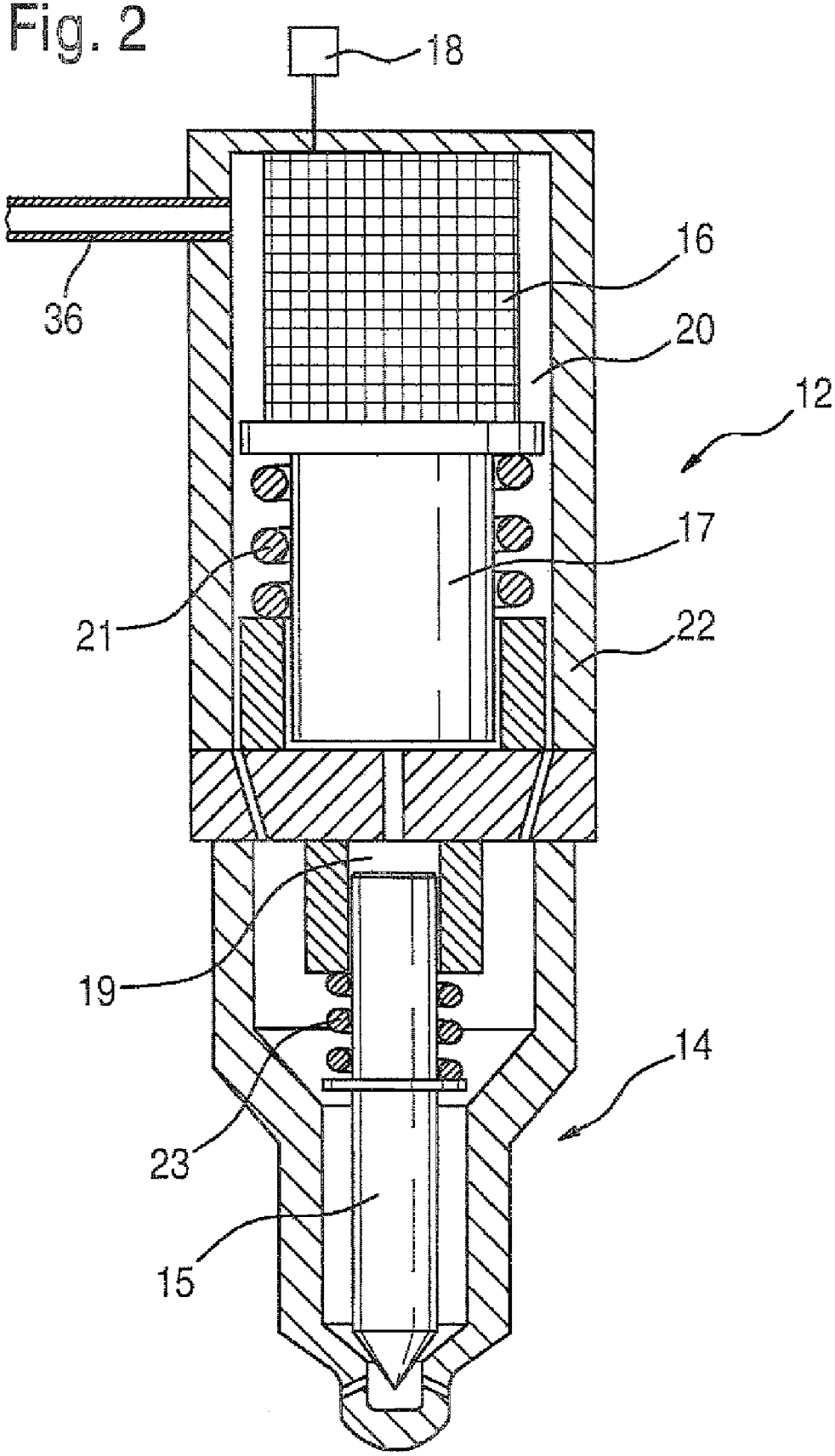
FIG. 2 is an enlarged depiction of an injector of the fuel injection device.
Figure 3:
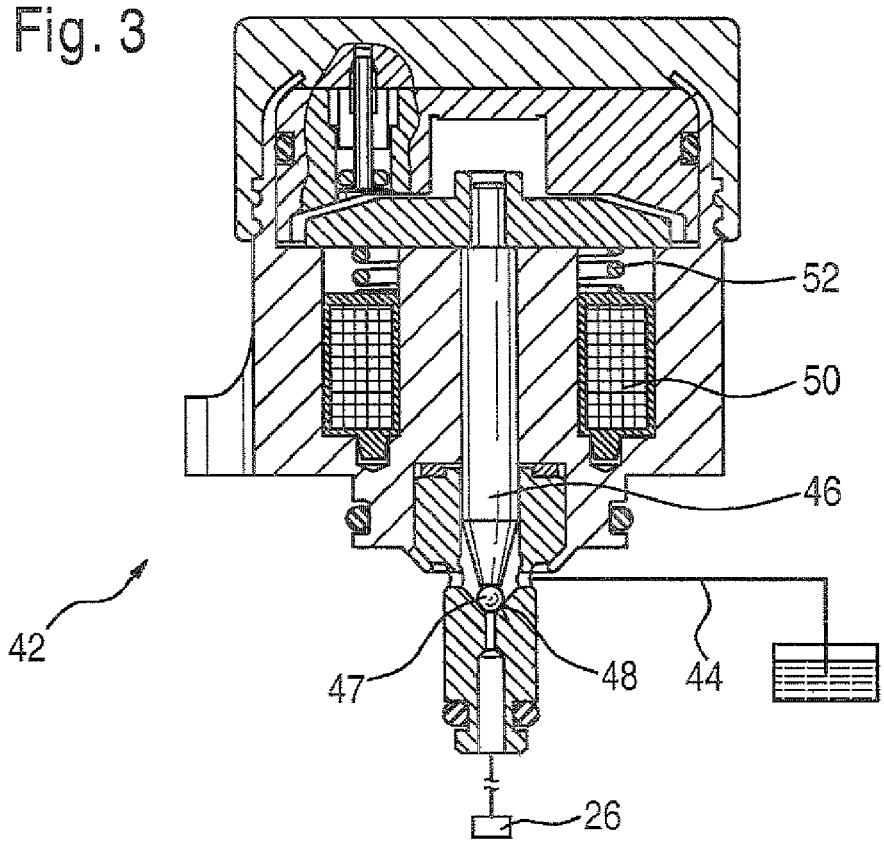
FIG. 3 is an enlarged depiction of a pressure control valve of the fuel injection device.

FIGS. 1 through 4 show a fuel injection device for a multicylinder internal combustion engine that is preferably an autoignition engine of a motor vehicle. The fuel injection device has a high-pressure pump 10 that delivers the fuel at a high pressure. Each cylinder of the internal combustion engine is provided with an injector 12 that is able to inject the fuel into the combustion chamber of the cylinder. Only some of the injectors 12 are shown in FIGS. 1 through 3; other injectors up to the last injector 12*d* are indicated by dots.

As shown in FIG. 2, the injector 12 has a fuel injection valve 14, which injects fuel into the combustion chamber of the cylinder, and has an electrically triggered actuator 16. The actuator controls the opening and closing motion of an injection valve member 15 of the fuel injection valve 14. The actuator 16 is preferably a piezoelectric actuator, whose size changes as a function of an electrical voltage applied to it. This size change can perform a switching function that is capable of opening or closing the injection valve member 15. An electronic control unit 18 triggers the actuator 16. The actuator 16 is situated in a fuel-filled chamber 20 in a housing 22 of the injector 12. The actuator 16 can, for example, act on a piston 17 that delimits a control chamber 19; the pressure prevailing in the control chamber 19 acts on the injection valve member 15 in the closing direction. A prestressed spring 21 holds the piston 17 in contact with the actuator 16. In addition, a prestressed spring 23 acts on the injection valve member 15 in the closing direction. When the control unit 18 causes an electrical voltage to be applied to the actuator 16, it expands and pushes the piston 17 into the control chamber 19, causing a high pressure to prevail therein, which holds the injection valve member 15 in its closed position so that no fuel injection occurs. When the control unit 18 does not supply any electrical voltage to the actuator 16, then it reduces in size so that the spring 21 moves the piston 17 out of the control chamber 19, thus causing the pressure to drop in the control chamber 19. Then the high pressure acting on the injection valve member 15 in the opening direction moves it into its open position in opposition to the pressure prevailing in the control chamber 19 and in opposition to the force of the spring 23 so that an injection of fuel occurs.

In the fuel injection device according to a first exemplary embodiment shown in FIG. 1, the high-pressure pump 10 delivers fuel into a reservoir 26. A fuel supply pump 30 that draws from a fuel tank 32 supplies fuel to the high-pressure pump 10. A fuel metering device 34 that is able to change the fuel quantity delivered by the high-pressure pump 10 can be provided between the fuel supply pump 30 and the high-pressure pump 10. For example, the fuel metering device 34 is able to adjust a variable flow cross section. The control unit 18 triggers the fuel metering device 34.

The injectors 12 are each connected to the reservoir 26 via a respective hydraulic line 36. The high-pressure region of the fuel injection device includes the reservoir 26, the hydraulic lines 36 from the reservoir 26 to the injectors 12, and the injectors 12 themselves. The high-pressure region contains a pressure sensor 40 that sends the control unit 18 a signal for the pressure prevailing in the high-pressure region. The high-pressure region also contains a pressure control valve 42 that the control unit 18 triggers in order to maintain a predetermined pressure in the high-pressure region. The pressure control valve 42 controls a connection 44 between the high-pressure region and a fuel-filled low-pressure region; the low-pressure region can be the fuel tank 32 or a region upstream or downstream of the fuel supply pump 30. The pressure sensor 40 and the pressure control valve 42 can be situated at any point in the high-pressure region, for example in the high-pressure pump 10, in the hydraulic line 24 between the high-pressure pump 10 and the reservoir 26, in the reservoir 26, in a line 36 between the reservoir 26 and the injectors 12, or in an injector 12. Aside from the connection 44 controlled by the pressure control valve 42, the high-pressure region has no other connection to the environment and is completely leak-tight.

As is shown in FIG. 3, the pressure control valve 42 has a valve member 46 with a for example spherical closing element 47 that cooperates with a valve seat 48 and that has the capacity to be moved by an electric actuator 50, for example an electromagnet or a piezoelectric actuator, in opposition to a return spring 52. In this case, the control unit 18 triggers the actuator 50. The return spring 52 acts on the valve member 46 in its opening direction in which its closing element 47 is lifted away from the valve seat 48, thus opening the connection 44 between the high-pressure region and the low-pressure region. When the control unit 18 triggers the actuator 50, the actuator keeps the valve member 46—in opposition to the return spring 52 and in opposition to the pressure prevailing in the high-pressure region—in its closed position in which its closing element 47 rests against the valve seat 48 so that the high-pressure region is disconnected from the low-pressure region. The pressure prevailing in the high-pressure region, for example in the reservoir 26, acts on the valve member 46 in its opening direction in which it is lifted away from the valve seat 48 and thus opens the connection 44 between the high-pressure region and the low-pressure region. If the actuator 50 is being not triggered, then the pressure prevailing in the high-pressure region opens the valve member 46 in opposition to the force of the closing spring 52, thus opening the connection 44 to the low-pressure region. During operation of the internal combustion engine, the control unit 18 triggers the fuel metering device 34 and the pressure control valve 42 so that a predetermined pressure that is required for the fuel injection to occur builds up in the high-pressure region. The pressure sensor 40 sends the control unit 18 a signal for the actual pressure in the high-pressure region.

When the internal combustion engine is switched off, the pressure control valve 42 is no longer being, triggered by the control unit 18 and therefore assumes its open switched position, as a result of which the high-pressure region is connected to the low-pressure region. When the fuel contained in the high-pressure region cools, it is thus possible for the volume in the high-pressure region to be replenished with fuel from the low-pressure region so that no gas can form in the high-pressure region. With a subsequent starting of the internal combustion engine, the control unit 18 triggers the pressure control valve 42 so that it moves into its closed position. When the high-pressure pump 10 delivers fuel, high pressure builds back up again quickly in the high-pressure region so that the engine can be operated after a short starting time.

Figure 4:
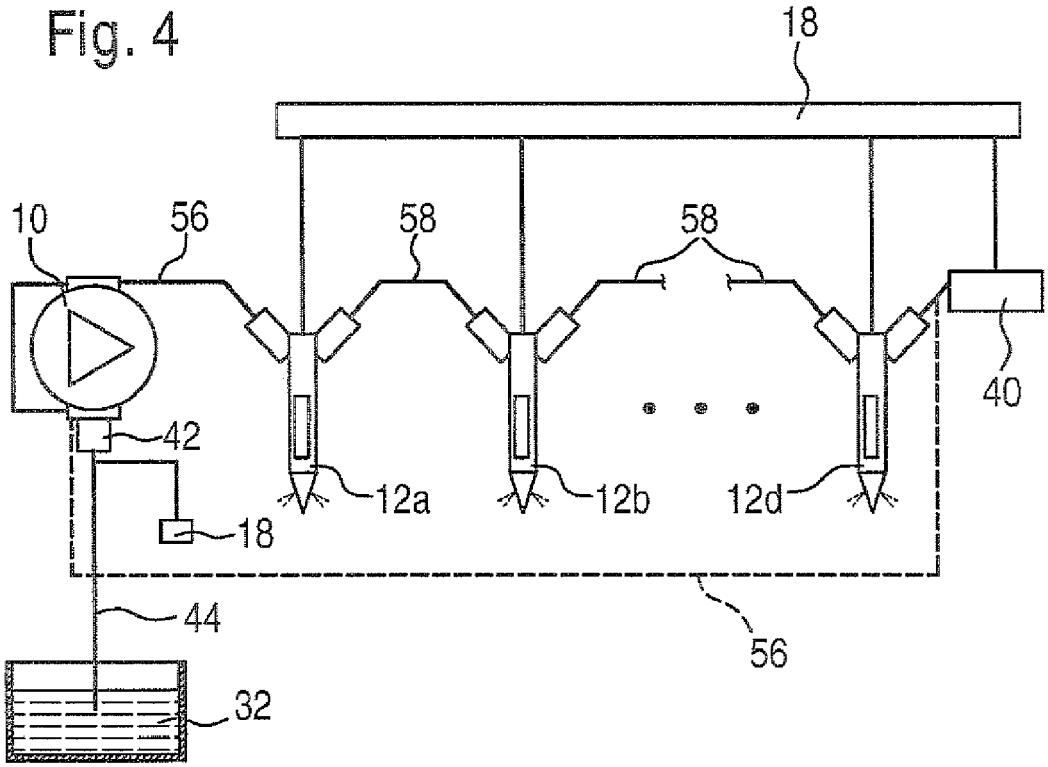
FIG. 4 shows the fuel injection device according to a second exemplary embodiment.

In a second exemplary embodiment of the fuel injection device shown in FIG. 4, the design is essentially the same as in the first exemplary embodiment, but no reservoir 26 is provided. A first injector 12*a*, which is preferably the injector of the engine situated the closest to the high-pressure pump 10, is connected to the high-pressure pump 10 via a hydraulic line 56. The next injector 12*b* is connected to the first injector 12*a* via a hydraulic line 58. The remaining injectors 12 are connected to one another in series via respective hydraulic lines 58. The hydraulic lines 56 and 58 each are each connected to the chamber 20 in the respective injector 12. The high-pressure region of the fuel injection device that includes the hydraulic lines 56, 58 and the injectors 12 is provided with the pressure sensor 40 and the pressure control valve 42, as in the first exemplary embodiment. The pressure sensor 40 and the pressure control valve 42 can, for example, be situated in the high-pressure pump 10, in the line 56 between the high-pressure pump 10 and the injector 12*a*, or in a line 58 between the injectors 12. The pressure control valve 42 is embodied the same as in the first exemplary embodiment so that when it is not being triggered by the control unit 18, it assumes its open switched position in which the connection 44 is open between the high-pressure region and the low-pressure region. In the fuel injection device according to the second exemplary embodiment, it is also alternatively possible for not only the first injector 12*a* to be connected directly to the high-pressure pump 10, but also for the last injector 12*d* to be connected directly to the high-pressure pump via a hydraulic line 56, as indicated with dashed lines in FIG. 4. The fuel injected through the fuel injection valve 14 of the injector 12 is drawn from the chamber 20 in which the actuator 16 is situated. The chamber 20 has a sufficiently large volume to permit the storage of the fuel volume required for the fuel injection. The volume of the chamber 20 can be between 1 and 5 $cm^3$, for example approximately 2 $cm^3$.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection device for an internal combustion engine comprising:

a high pressure pump that delivers fuel into a high-pressure region containing at least one injector that injects fuel into a cylinder of the engine, an electric control unit that controls the fuel injection of the at least one injector, and a pressure control valve operable to adjust the pressure prevailing in the high-pressure region, the pressure control valve being connected to control a connection of the high-pressure region to a fuel-filled low-pressure region and being triggered by the control unit to open a connection between the high-pressure region and the low-pressure region, and when it is not being triggered by the control unit, the pressure control valve assumes an open switched position in which the connection between the high-pressure region and the low-pressure region is open, such that when the internal combustion engine is switched off and the control unit is not triggering the pressure control valve, the high-pressure region is connected to the low-pressure region. thus preventing a degassing of the fuel in the high-pressure region.

2. The fuel injection device as recited in claim 1, where the high-pressure region comprises a reservoir which the high-pressure pump supplies with fuel and which is connected to the at least one injector.

3. The fuel injection device as recited in claim 1, wherein the at least one injector comprises an electric actuator and a fuel injection valve, wherein the actuator controls with a fuel injection of the fuel injection valve, wherein and the actuator is situated in a chamber of the injector that is connected to the high-pressure region.

4. The fuel injection device as recited in claim 2, wherein the at least one injector comprises an electric actuator and a fuel injection valve, wherein the actuator controls with a fuel injection of the fuel injection valve, wherein and the actuator is situated in a chamber of the injector that is connected to the high-pressure region.

5. The fuel injection device as recited in claim 3, wherein, when it is being triggered by the control unit, the actuator holds the fuel injection valve closed and when it is not being triggered by the control unit, the actuator opens the fuel injection valve for a fuel injection.

6. The fuel injection device as recited in claim 4, wherein, when it is being triggered by the control unit, the actuator holds the fuel injection valve closed and when it is not being triggered by the control unit, the actuator opens the fuel injection valve for a fuel injection.

7. The fuel injection device as recited in claim 5, wherein the actuator controls the pressure prevailing in a control chamber, which pressure at least indirectly acts on an injection valve member of the fuel injection valve in the closing direction.

8. The fuel injection device as recited in claim 6, wherein the actuator controls the pressure prevailing in a control chamber, which pressure at least indirectly acts on an injection valve member of the fuel injection valve in the closing direction.

9. The fuel injection device as recited in claim 3, wherein the fuel that is injected by the fuel injection valve is drawn from the chamber in which the actuator is situated.

10. The fuel injection device as recited in claim 4, wherein the fuel that is injected by the fuel injection valve is drawn from the chamber in which the actuator is situated.

11. The fuel injection device as recited in claim 5, wherein the internal combustion engine has several cylinders, each of which is provided with an injector; wherein at least two of the injectors are directly connected to the high-pressure pump; wherein and the remaining injectors are connected in series with one another via hydraulic lines and are indirectly connected to the high-pressure pump via the at most two injectors that are directly connected to the high-pressure pump.

12. The fuel injection device as recited in claim 7, wherein the internal combustion engine has several cylinders, each of which is provided with an injector; wherein at least two of the injectors are directly connected to the high-pressure pump; wherein and the remaining injectors are connected in series with one another via hydraulic lines and are indirectly connected to the high-pressure pump via the at most two injectors that are directly connected to the high-pressure pump.

13. The fuel injection device as recited in claim 9, wherein the internal combustion engine has several cylinders, each of which is provided with an injector; wherein at least two of the injectors are directly connected to the high-pressure pump; wherein and the remaining injectors are connected in series with one another via hydraulic lines and are indirectly connected to the high-pressure pump via the at most two injectors that are directly connected to the high-pressure pump.

14. The fuel injection device as recited in claim 1, wherein the connection controlled by the pressure control valve is the only connection between the high-pressure region and a low-pressure region.

15. The fuel injection device as recited in claim 3, wherein the connection controlled by the pressure control valve is the only connection between the high-pressure region and a low-pressure region.

16. The fuel injection device as recited in claim 5, wherein the connection controlled by the pressure control valve is the only connection between the high-pressure region and a low-pressure region.

17. The fuel injection device as recited in claim 7, wherein the connection controlled by the pressure control valve is the only connection between the high-pressure region and a low-pressure region.

18. The fuel injection device as recited in claim 9, wherein the connection controlled by the pressure control valve is the only connection between the high-pressure region and a low-pressure region.

19. A fuel injection device for an internal combustion engine comprising:

a high pressure pump that delivers fuel into a high-pressure region containing at least one injector that injects fuel into a cylinder of the engine, an electric control unit that controls the fuel injection of the at least one injector, and a pressure control valve operable to adjust the pressure prevailing in the high-pressure region, the pressure control valve being connected to control a connection of the high-pressure region to a fuel-filled low-pressure region and being triggered by the control unit to open a connection between the high-pressure region and the low-pressure region, and when it is not being triggered by the control unit, the pressure control valve assumes an open switched position in which the connection between the high-pressure region and the low-pressure region is open.

wherein the at least one injector comprises an electric actuator and a fuel injection valve, wherein the actuator controls fuel injection of the fuel injection valve, wherein the actuator is situated in a chamber of the injector that is connected to the high-pressure region, and wherein the internal combustion engine has several cylinders, each of which is provided with an injector; wherein at least two of the injectors are directly connected to the high-pressure pump; wherein the remaining injectors are connected in series with one another via hydraulic lines and are indirectly connected to the high-pressure pump via the at most two injectors that are directly connected to the high-pressure pump.

20. The fuel injection device as recited in claim 19, wherein the connection controlled by the pressure control valve is the only connection between the high-pressure region and a low-pressure region.

* * * * *